US006899066B2

(12) United States Patent
Tiller et al.

(10) Patent No.: US 6,899,066 B2
(45) Date of Patent: May 31, 2005

(54) VALVE ASSEMBLY

(75) Inventors: Timothy T. Tiller, Blue River, WI (US); David P. Roethel, LaFarge, WI (US); Floyd I. Baker, Readstown, WI (US)

(73) Assignee: S & S Cycle, Inc., Viola, WI (US)

( * ) Notice: Subject to any disclaimer, the term of this patent is extended or adjusted under 35 U.S.C. 154(b) by 9 days.

(21) Appl. No.: 10/334,300

(22) Filed: Dec. 30, 2002

(65) Prior Publication Data

US 2004/0123823 A1 Jul. 1, 2004

(51) Int. Cl.[7] ..... F02B 75/02
(52) U.S. Cl. ..... 123/65 V
(58) Field of Search ..... 123/65 V, 73 V; 137/512.1, 856

(56) References Cited

U.S. PATENT DOCUMENTS

| | | | | |
|---|---|---|---|---|
| 4,082,295 A | * | 4/1978 | Bainard | 277/309 |
| 4,643,139 A | * | 2/1987 | Hargreaves | 123/65 V |
| 4,696,263 A | * | 9/1987 | Boyesen | 123/65 V |
| 5,243,934 A | * | 9/1993 | Boyesen | 123/73 V |
| 6,189,496 B1 | | 2/2001 | Heffner et al. | |
| 6,457,449 B1 | * | 10/2002 | Troxler et al. | 123/196 R |

FOREIGN PATENT DOCUMENTS

| | | |
|---|---|---|
| JP | 2-207127 | 8/1990 |
| JP | 3-100317 | 4/1991 |
| JP | 4-72423 | 3/1992 |
| JP | 4-121420 | 4/1992 |
| JP | 5-163951 | 6/1993 |
| JP | 5-179971 | 7/1993 |
| JP | 5-195794 | 8/1993 |
| JP | 5-195795 | 8/1993 |
| JP | 6-117262 | 4/1994 |
| JP | 6-200768 | 7/1994 |
| JP | 6-307561 | 11/1994 |
| JP | 9-242551 | 9/1997 |
| JP | 8-74580 | 3/1998 |
| JP | 8-105328 | 4/1998 |
| JP | 8-151928 | 6/1998 |
| JP | 8-210142 | 8/1998 |
| JP | 10-220234 | 8/1998 |
| JP | 2003-343232 | 12/2003 |

* cited by examiner

*Primary Examiner*—Mahmoud Gimie
*Assistant Examiner*—Hyder Ali
(74) *Attorney, Agent, or Firm*—Heller Ehrman White and McAuliffe

(57) ABSTRACT

A valve assembly for a motorcycle engine including a valve body and a plurality of reed valve constructions. The valve assembly is configured for receipt within an aperture of an engine wall extending between the crankcase and the cam chest of the engine. In particular, the valve assembly is configured to fit within a bearing support structure and seal around a pinion shaft.

19 Claims, 11 Drawing Sheets

DETAIL A1

DETAIL A2

VALVE ASSEMBLY

BACKGROUND OF THE INVENTION

I. Field of the Invention

The present invention relates to a valve assembly. In particular, the present invention relates to a reed valve assembly for use with a motorcycle engine.

II. Description of Related Prior Art

A variety of lubrication systems for engines, such as, motorcycle engines, exist. Some of the systems relate to controlling the pressure differential between the crankcase, cam chest, and the rocker box to facilitate the return of oil from the rocker box to the crankcase. FIG. 1 illustrates a prior art motorcycle engine 11 incorporating one conventional valve assembly 17. The illustrated conventional valve assembly 17 is manufactured and sold by Harley-Davidson of Milwaukee, Wis. The engine 11 has an aperture 13 formed in a wall 15 between the crankcase and cam chest. The valve assembly 17 is positioned to cover the aperture 13 and is configured to permit one-way flow of air from the crankcase into the cam chest in response to pressure differentials caused by reciprocation of the engine's pistons.

As shown in FIGS. 2–4 the conventional valve assembly 17 includes a valve body 19 having at least one bore 27. The illustrated valve body 19 includes more than one bore 27. A flexible member 21 is secured to the valve body 19 by a fastener 23. The flexible member 21 is configured such that the circumference of the flexible member flexes away from the valve body 19 to open fluid communication through the bores 27; the flexure of the member 21 resulting from a pressure differential caused by reciprocation of the engine's pistons. In particular, the flexible member 21 opens or flexes away from the valve body 19 to provide fluid communication between the crankcase and cam chest when the pressure differential in the crankcase is greater than in the cam chest (represented by arrow A). The flexible member 21 closes or covers the bores 27 of the valve body 19 (as shown in FIG. 2) to prevent fluid communication through the bores 27 when the pressure differential in the cam chest is greater than in the crankcase (represented by arrow B).

Another conventional valve assembly is described in U.S. Pat. No. 6,457,449. Similar to the previously described arrangement, this valve assembly includes a valve body (116 of FIG. 5) having at least one bore (136). A flexible member (120) is secured to the valve body by a fastener (160). The valve assembly is positioned to cover an aperture (108 of FIG. 4) in a wall between the crankcase and cam chest, and is configured to permit one-way flow of air from the crankcase into the cam chest in response to pressure differentials caused by reciprocation of the engine's pistons.

In general, improvement has been sought with respect to such valve assemblies, generally to better accommodate: engine manufacturing efficiency and ease of retrofitting and improving engine performance. The present invention addresses such needs.

SUMMARY

One aspect of the present invention relates to a reed valve assembly including a valve body sized and configured for receipt within an aperture formed in a wall of a motorcycle engine. The reed valve assembly has a plurality of reed valve constructions positioned adjacent to fluid communication passages of the valve body to provide one-way fluid communication through the passages.

Another aspect of the present invention relates to a valve assembly including a valve body having a central bore and at least a first fluid communication passage. A valve construction is secured to the valve body adjacent to the fluid communication passage. A first seal is positioned adjacent to the central bore and is configured to engage a shaft positioned through the central bore.

Yet another aspect of the present invention relates to a motorcycle engine including a crankcase, a cam chest, a wall between the crankcase and cam chest, the wall defining an aperture through which a shaft extends. The motorcycle engine also includes a valve assembly positioned within the aperture that opens and closes in response to pressure differentials between the crankcase and cam chest.

A variety of aspects of the invention are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are exemplary and explanatory only, and are not restrictive of the claimed invention.

DETAILED DESCRIPTION

Reference will now be made in detail to exemplary aspects of the present invention that are illustrated in the accompanying drawings. Wherever possible, the same reference numbers will be used throughout the drawings to refer to the same or like parts.

FIGS. 5–15 illustrate a valve assembly 40 having features that are examples of how inventive aspects in accordance with the principles of the present invention may be practiced.

Figure 1:
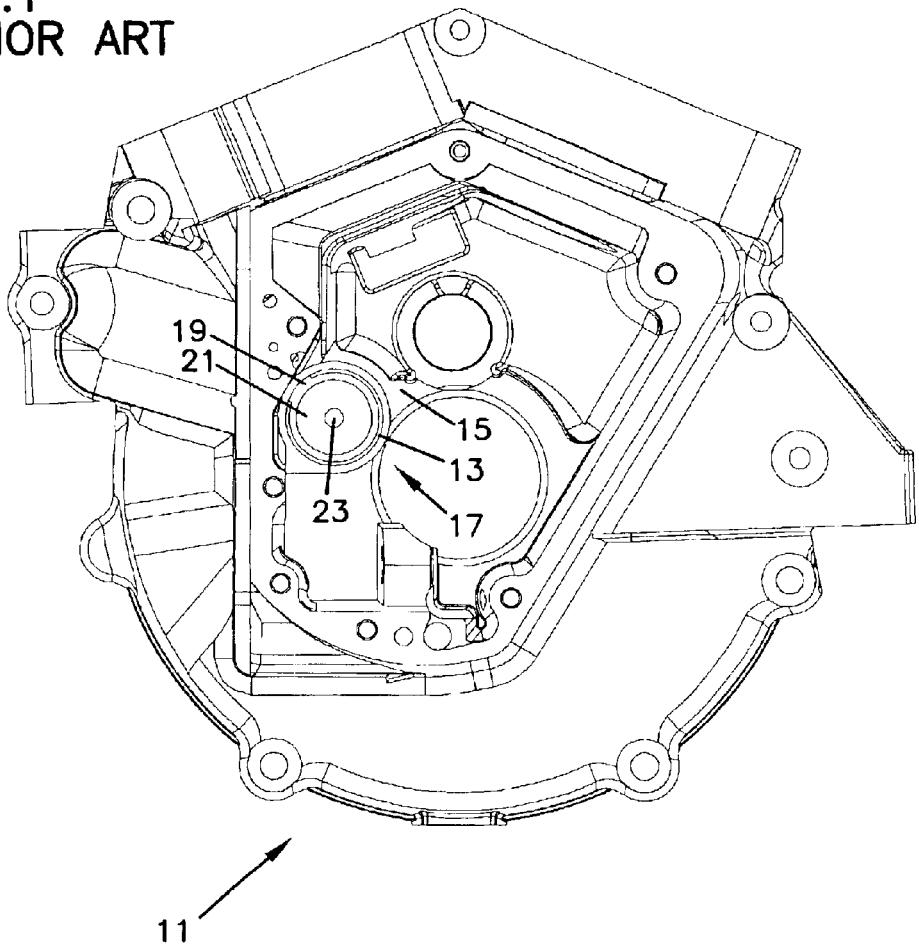
FIG.1 PRIOR ART
FIG. 1 is a side elevational view of a conventional valve assembly installed in a motorcycle engine.
Figure 2:
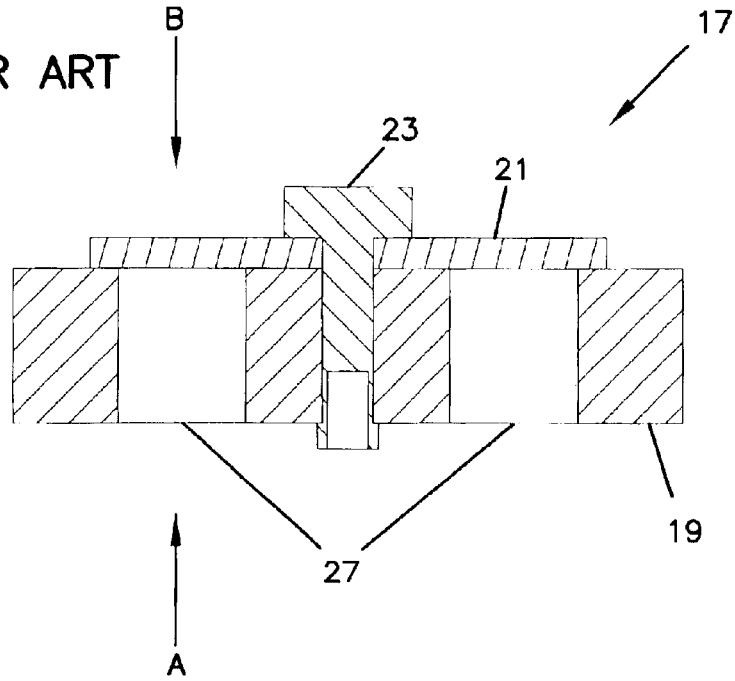
FIG.2 PRIOR ART
FIG. 2 is a cross-sectional view of the conventional valve assembly shown in FIG. 1.
Figure 3:
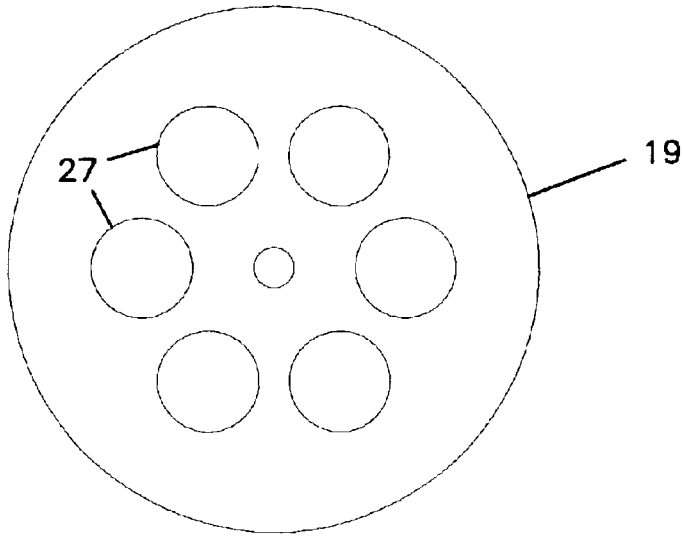
FIG.3 PRIOR ART
FIG. 3 is a top plan view of a valve body of the valve assembly of FIG. 2.
Figure 4:
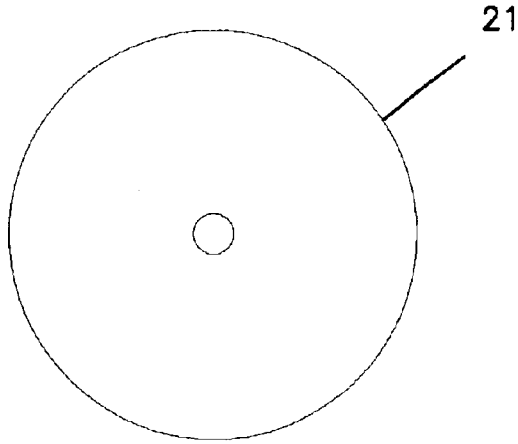
FIG.4 PRIOR ART
FIG. 4 is a top plan view of a flexible member of the valve assembly of FIG. 2.
Figure 5:
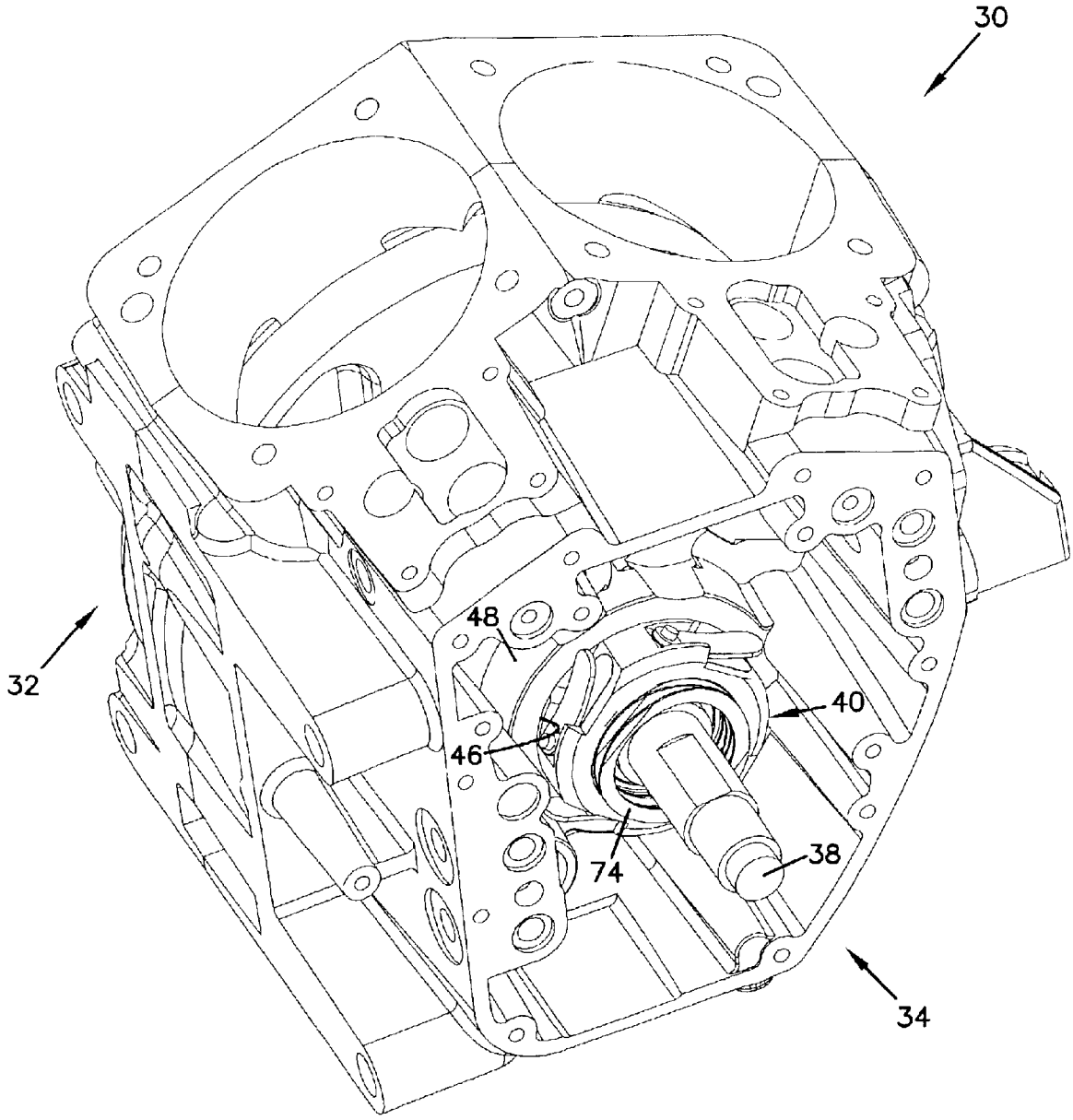
FIG. 5 is a top perspective view of an engine having one embodiment of a reed valve assembly according to the principles disclosed.
Figure 6:
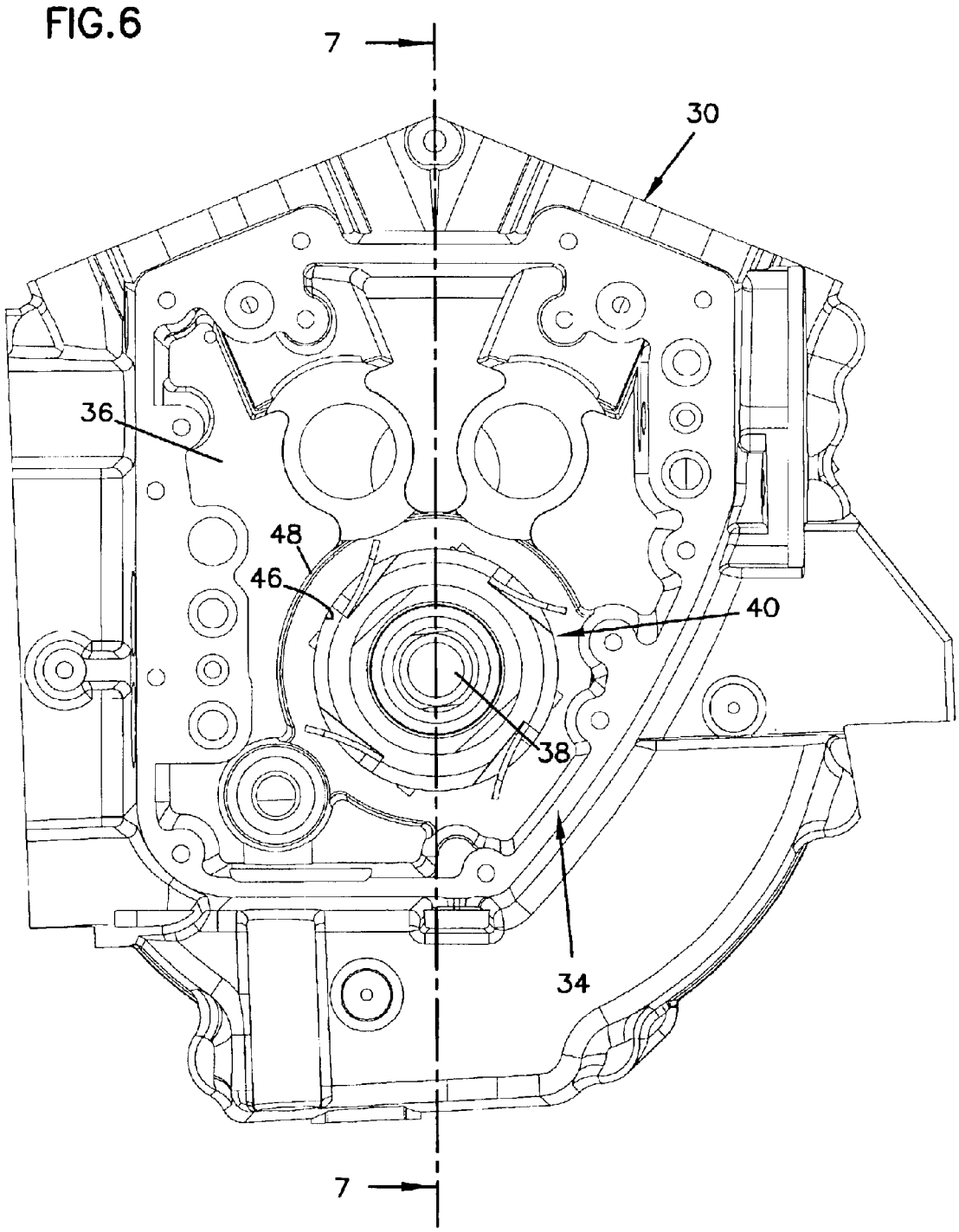
FIG. 6 is a side elevational view of the engine and reed valve assembly of FIG. 5.

Referring first to FIG. 5, one embodiment of the valve assembly 40 installed on a typical motorcycle engine 30 is illustrated. The engine generally has a crankcase 32 (also shown in FIG. 7), a cam chest 34, and a wall 36 (FIGS. 6 and 7) that separates the crankcase 32 from the cam chest 34.

Figure 7:
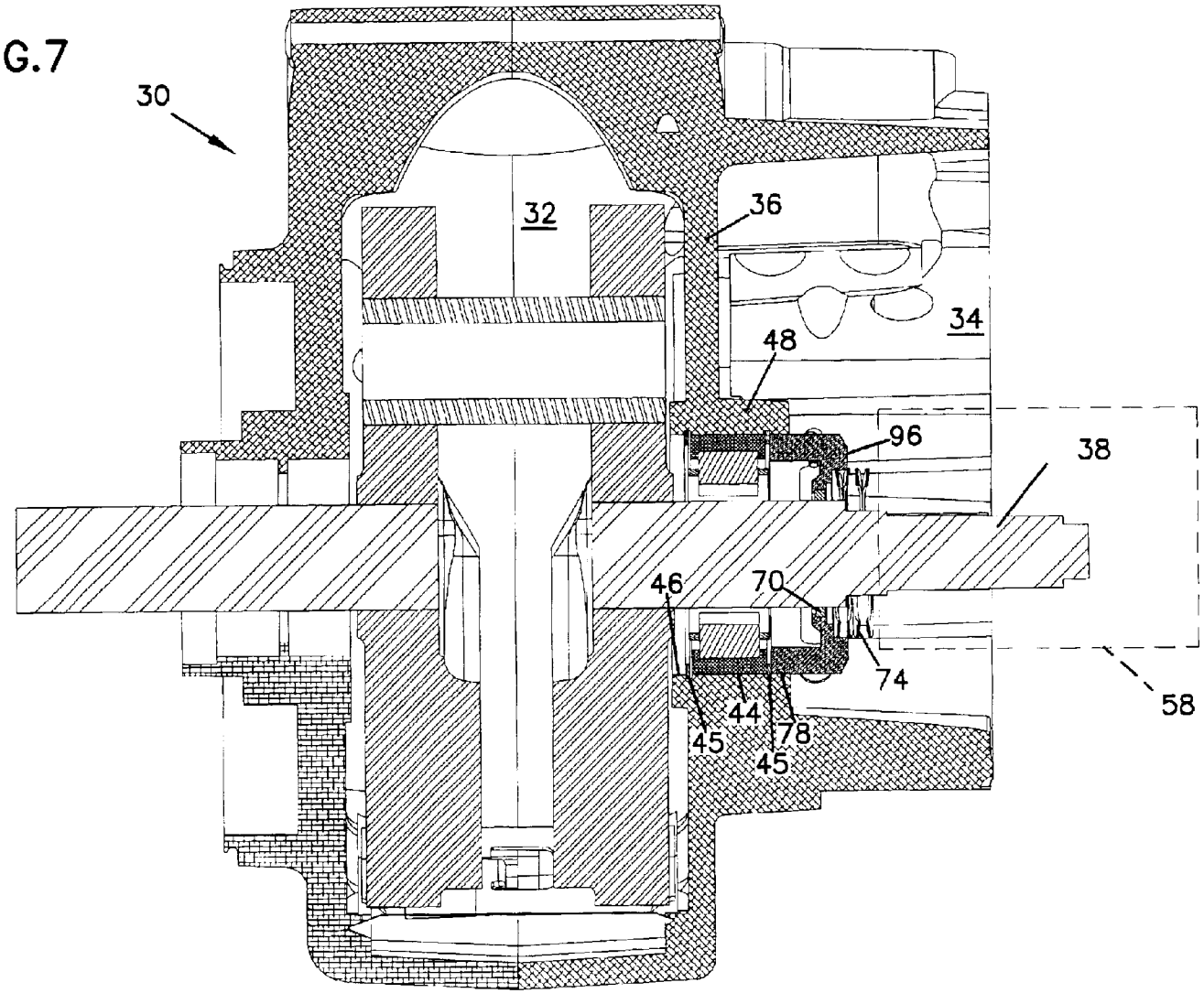
FIG. 7 is a cross-sectional view of FIG. 6 taken along line 7—7.

As shown in FIG. 7, the wall 36 of the motorcycle engine 30 includes a pinion shaft aperture 46. The valve assembly 40 is sized and configured to fit within the shaft aperture 46 of the wall 36. In the illustrated embodiment, the shaft aperture 46 is formed by a bearing support structure or boss 48. The boss 48 is configured for receipt of a bearing 44. The bearing 44 is maintained within the boss 48 by retaining rings 45. The engine 30 includes a pinion shaft 38 that is supported by the bearing 44. The shaft 38 extends from the crankcase 32 through the shaft aperture 46 of the wall 36 and into the cam chest 34.

In one aspect, the valve assembly 40 of present invention is provided to increase an motorcycle engine's performance and efficiency without significant engine modification. In particular, the valve assembly 40 is configured to fit within an existing shaft aperture of a motorcycle engine so that additional machining or modifications are not required to improve the performance of an existing engine. In another aspect, the valve assembly 40 of the present invention is provided to reduce machining and simplify engine design by utilizing the shaft aperture for controlled fluid communication between the crankcase and the cam chest. In each aspect, the valve assembly 40 is configured to fit within the shaft aperture 46 and around the pinion shaft 38.

The valve assembly 40 operates by permitting air and oil mist to flow from the crankcase 32 to the cam chest 34, while preventing reverse airflow. The flow between the crankcase 32 and the cam chest 34 is referred to as air or airflow and may include air, oil mist, and any other gases or particles that may be present in the engine crankcase and cam chest. As the pistons reciprocate, alternating pressure and vacuums are formed in the crankcase 32. When the pistons move upward, a vacuum is formed in the crankcase. The valve assembly 40 is configured to prevent air from being drawn from the cam chest 34 to the crankcase 32. This controls or manages the amplitude of pressure fluctuations and pressure waves in the cam chest 34.

To further elaborate, pistons in an engine operate like an air pump. As the pistons reciprocate, the air above and below the pistons is displaced (causing airflow) and compressed (causing pressure waves). In common engine designs, airflow going to and from the crankcase and cam chest is permitted through the pinion bearing. Accordingly, airflow is also permitted to and from an engine's rocker box, which is in fluid communication with the cam chest. In particular, air moves out of the crankcase into the cam chest and rocker box when the piston moves downward; and air is pulled into the crankcase from the cam chest and rocker box when the piston moves upward. A one-way valve located in an engine wall between the crankcase and cam chest can control this pumping action.

The pumping action control or stabilization of pressure waves and fluctuations of the present invention provides different advantages depending upon the type of motorcycle engine. For example, in a twin-cam engine configuration, oil from the rocker box is designed to drain back into the cam chest. The present invention stabilizes the pumping action within this type of engine by reducing the amplitude of pressure fluctuations and pressure waves in the cam chest 34. Reduced amplitude of pressure waves and fluctuations in the cam chest 34 provides a more stable environment in the rocker box. In the twin-cam engine, the stabilized environment in both the cam chest and rocker box permits oil in the rocker box to more readily drain back into the cam chest.

In contrast, other engine configurations are designed such that oil from the rocker box flows to the crankcase through separate crankcase passages. The present invention controls the pumping action within this type of engine by stabilizing and enhancing the pumping cycle. That is, the one-way airflow is enhanced to force oil in the rocker box to return to the crankcase via the separate crankcase passages.

In the absence of one-way airflow, fluctuating pressure waves disrupt oil flow from the rocker box to either the cam chest or crankcase passages, depending on the engine type. In either situation, this disruption can cause the rocker box to fill to a level where the oil exits the engine through a breather vent. The present invention is designed to control the engine's airflow pattern and either reduce pressure fluctuations in the cam chest, or enhance the engine's pumping cycle, depending upon the engine type.

Figure 8:
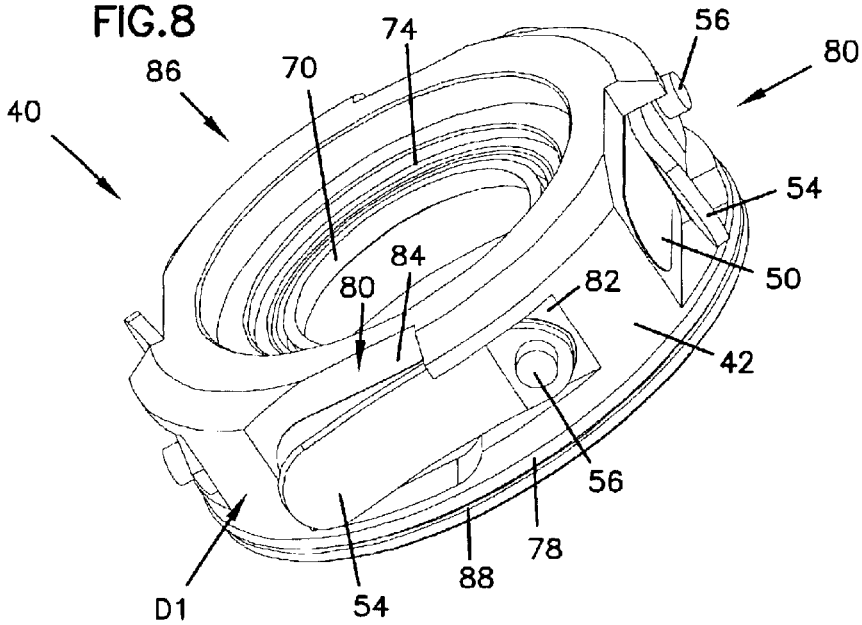
FIG. 8 is a perspective view of the reed valve assembly shown in FIG. 5.
Figure 9:
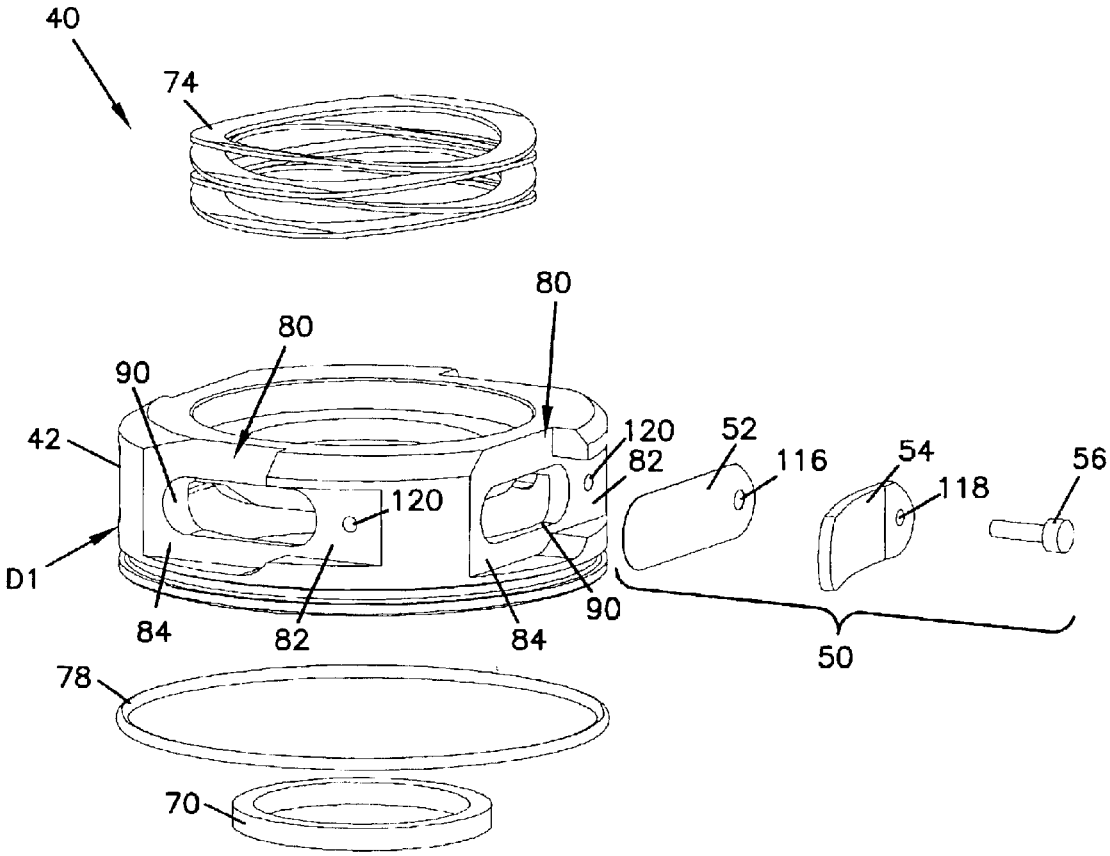
FIG. 9 is an exploded assembly view of the reed valve assembly of FIG. 8.

Referring now to FIGS. 8 and 9, valve assembly 40 generally includes a valve body 42, a plurality of valve constructions 50, a biasing member 74, an o-ring 78, and a seal 70. The valve constructions 50 include a moveable member 52, a stop 54, and a fastener 56 that secures the moveable member 52 and the stop 54 to the valve body 42.

Figure 11:
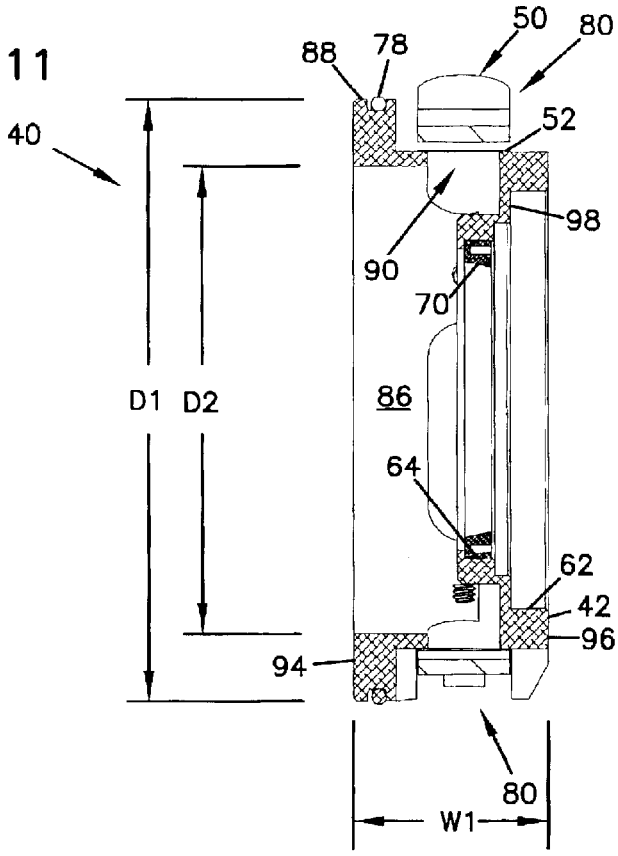
FIG. 11 is a cross-sectional view of FIG. 10 taken along line 11—11.

As shown in FIGS. 8 and 9, the valve body 42 of the illustrated embodiment is disk shaped or has an annular ring configuration. Referring now to FIG. 11, the valve body 42 has an outer diameter D1, a central bore 86 have at least primary inner diameter D2, and a width W1. The width W1 is defined between a first side 94 and second side 96 of the valve assembly 40.

The outer diameter D1 of the valve body 42 is sized for receipt within the aperture 46 of the engine wall 36. Preferably the outer diameter D1 is between 1.5 inches and 4.0 inches; more preferably the outer diameter D1 is between 2.75 inches and 3.0 inches; most preferably the outer diameter D1 is about 2.8 inches.

The primary inner diameter D2 of the valve assembly 40 is configured to provide sufficient airflow communication between the crankcase and the cam chest during the down stroke of the engine's piston. The primary inner diameter D2 is preferably between 1.0 inches and 3.5 inches; more preferably the primary inner diameter D2 is between 1.75 inches and 2.5 inches; most preferably the primary inner diameter D2 is about 2.2 inches.

The width W1 of the valve assembly is sized to fit within the cam chest between the outer retaining ring 45 that retains the bearing 44 and an oil pump 58 (shown schematically in FIG. 7). The width W1 is preferably between 0.5 inches and 1.5 inches; more preferably the width W1 is between 0.75 inches and 1.0 inches; most preferably the width W1 is about 0.85 inches.

Figure 12:
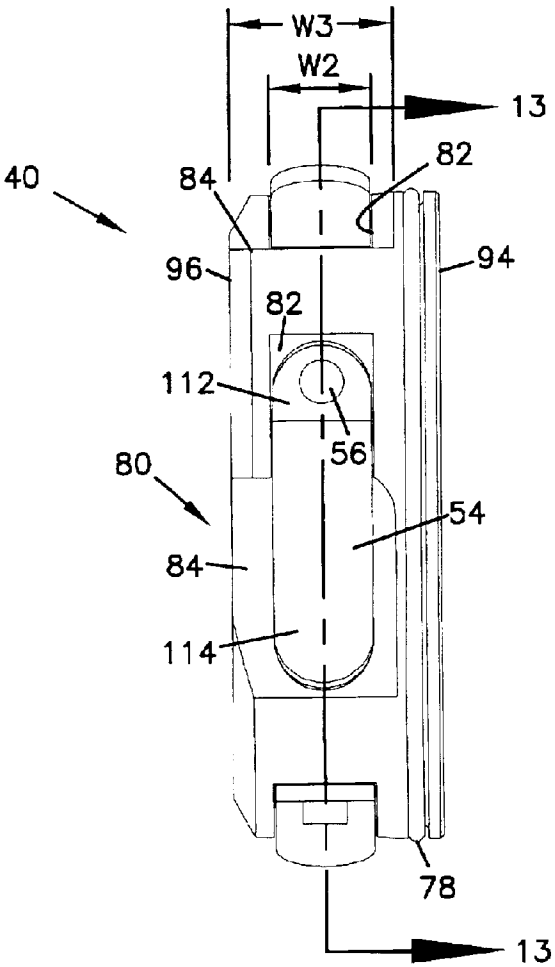
FIG. 12 is a front elevational view of the reed valve assembly of FIG. 8.

Referring back to FIG. 9, the valve body 42 of the valve assembly 40 includes a plurality of recesses 80 formed on the outer diameter D1. Each of the recesses 80 includes a channel portion 82 and a notch portion 84. The channel portion 82 is cut into the outer diameter D1 of the valve body and extends to the notch portion 84. Referring to FIG. 12, the channel portion 82 is located between the first and second sides 94, 96 of the valve body and has a width W2. In the illustrated embodiment, the width W2 of the channel portion 82 does not extend to the edges of either the first or second sides 94, 96. The notch portion 84 has a width W3 that is greater than the width W2 of the channel portion 82. The width W3 of the notch portion 84 is located adjacent to the first side 94 of the valve body 42 and extends to the edge of the second side 96.

Referring back to FIG. 9, at least one fluid communication passage 90 is formed in the valve body 42. In the illustrated embodiment, a passage 90 is located at each of the recesses 80. As shown in FIG. 11, the passages 90 extend between the primary inner diameter D2 and the outer diameter D1 of the valve body. When assembled, the valve assembly 40 permits one-way airflow through the fluid communication passages 90 in a direction from the first side 94 of the valve assembly 40 to the second side 96 of the valve assembly.

Referring still to FIG. 11, an annular groove 88 is formed in the outer diameter D1 of the valve body 42. The o-ring 78 (FIG. 9) is positioned with the annular groove 88. As shown in FIG. 7, the o-ring 78 provides a seal between the valve body 42 and the shaft aperture 46 of the engine wall 36 to prevent air and oil mist from moving between the crankcase 32 and the cam chest 34. The o-ring 78 also aids to reduce the amount of vibrations that the valve assembly 40 experiences during engine operation. The seal 70 (FIG. 9) also provides a seal between the valve body 42 and the pinion shaft 38 to prevent air and oil mist from moving between the cam chest 34 and the crankcase 32.

Still referring to FIG. 7, the biasing member 74 (FIG. 9) of the valve assembly 40 is arranged and configured to hold the valve assembly in a position between the outer retaining ring 45 and the oil pump 58. In the illustrated embodiment, the biasing member is a wave spring 74 that biases against the second side 96 of the valve body 42 when the oil pump 58 is assembled to the motorcycle engine. In alternative embodiments, belleville washers, compression spring arrangements, or other types of biasing members can be used to maintain the position of the valve assembly. It is also contemplated that retaining ring configurations, keyways, and other mechanical connections can be used to secure the valve assembly in position.

As shown in FIG. 11, the valve body 42 includes at least a first counterbore 62 and a second counterbore 64. The first counterbore 62 is configured to receive the wave spring 74. The second counter bore is configured to receive the seal 70.

Figure 16:
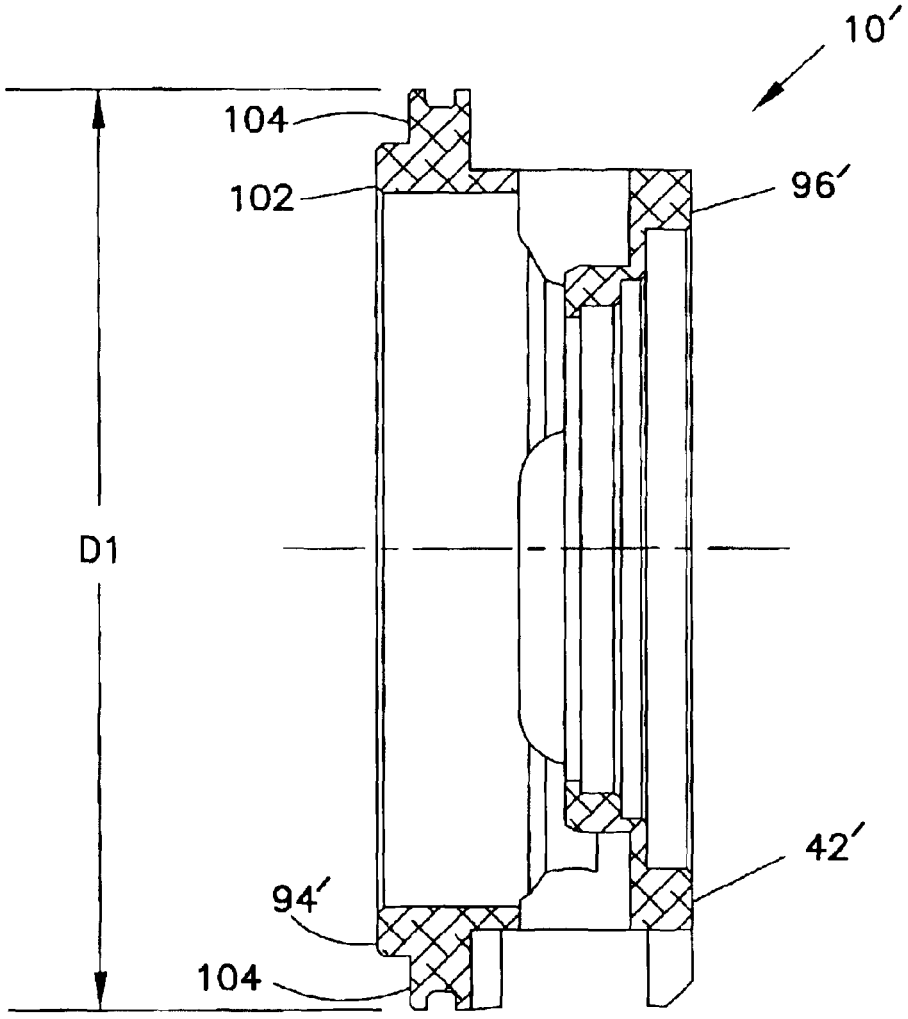
FIG. 16 is a cross-sectional view of another embodiment of a reed valve assembly according to the principles disclosed.
Figure 17:
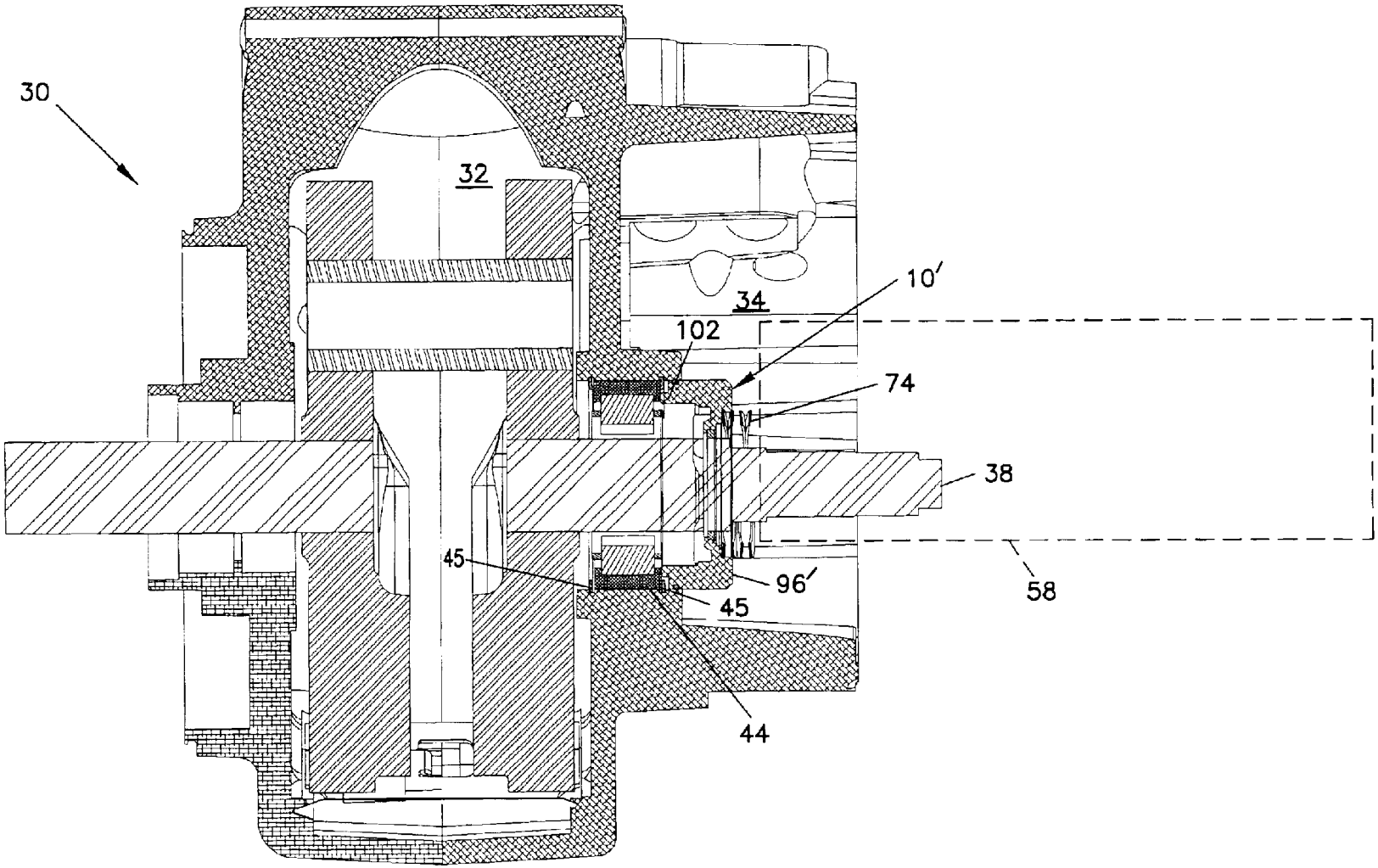
FIG. 17 is a cross-sectional view of an engine showing the installation of the reed valve assembly of FIG. 16.

Referring now to FIGS. 16 and 17, an alternative embodiment of the valve assembly 10' is illustrated. In this embodiment, the valve body 42' is similar to the previous embodiment but configured so that the valve assembly fits within the cam chest between the bearing 44 and the oil pump 58 (FIG. 17). In particular, the first side 94' of the valve body 42' includes a boss or step 102 configured to contact the bearing 44 (FIG. 17), rather than the outer retaining ring 45. In the preferred embodiment, the step 102 is positioned such that the step fits within the inner diameter of the outer retaining ring 45 and contacts only the bearing 44. The first side 94' can also define an annular notch 104 configured to provide clearance for the outer retaining ring 45 between the bearing 44 and the valve body 42. In the illustrated embodiment, the annular notch 104 is located between the outer diameter D1 of the valve body '42 and the step 102.

Figure 10:
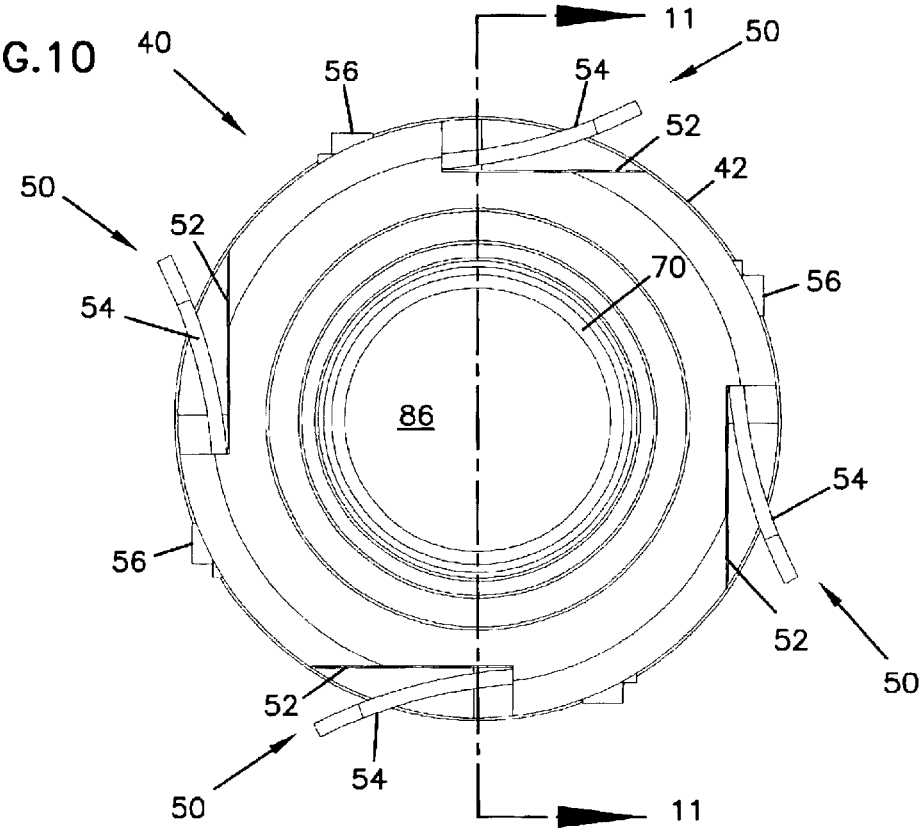
FIG. 10 is a side elevational view of the reed valve assembly of FIG. 8.

Referring to FIGS. 9 and 10, the valve constructions 50 of the present invention are arranged to operate as a one-way valve that permits air and oil mist to flow out of the crankcase 32 and into the cam chest 34, and prevents the air and oil mist from returning. The valve constructions 50 are positioned within the recesses 80, and adjacent to the passages 90 of the valve body 42. In particular, the movable member 52 of each valve construction is positioned over the passage 90 of the valve body 42.

The illustrated embodiment has four valve constructions 50 positioned over four passages 90. It is contemplated that the valve assembly 40 can be configured with more than four, or less than four, valve constructions and passages. Each of the valve constructions and passages are oriented about the valve body at uniform intervals, i.e. each is spaced approximately 90-degree from one another. It is also contemplated that the valve constructions and passages can be oriented about the valve body at non-uniform intervals.

Figure 13:
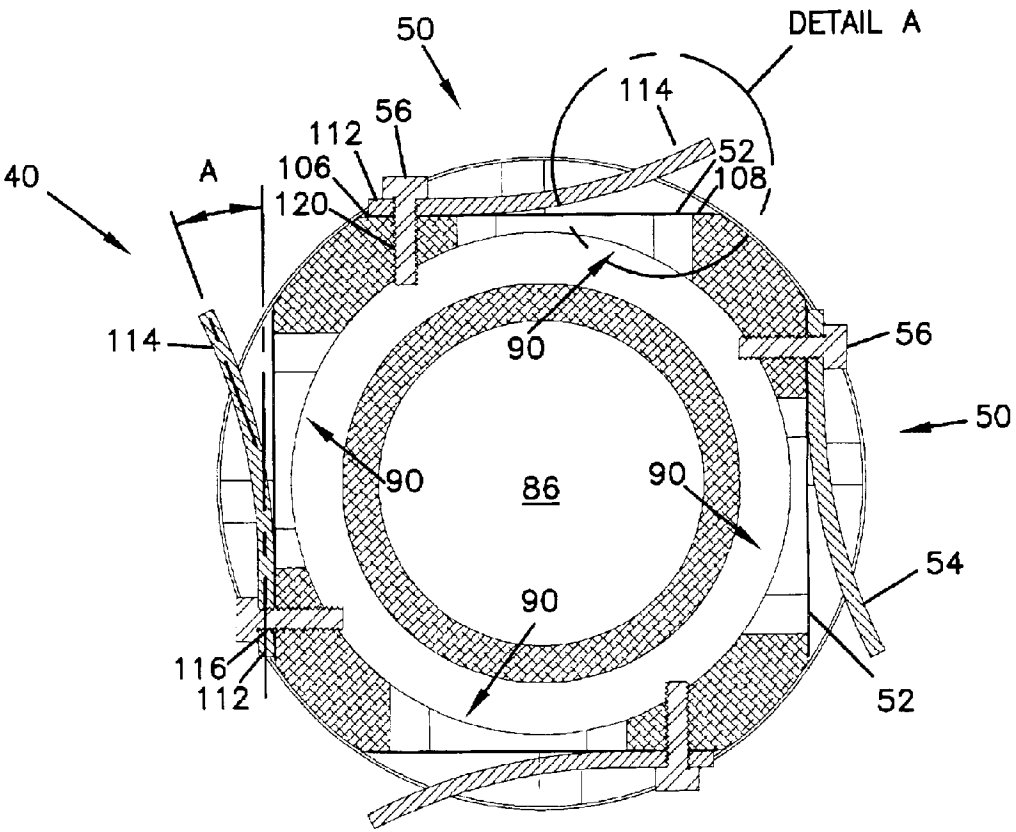
FIG. 13 is a cross-sectional view of FIG. 12 taken along line 13—13.

Referring now to FIGS. 9 and 13, the moveable member 52 of each valve construction 50 includes a first end 106 and a second end 108. The first end 106 of the moveable member 52 includes a through hole 116. The stop 54 of the valve construction 50 also includes a first end 112 and a second end 114. The first end 112 of the stop 54 includes a through hole 118.

The first end 106 of the moveable member 52 is positioned within the channel portion 82 of the recess 80 and the second end 108 is positioned within the notch portion 84 of the recess 80. In the preferred embodiment, at least the first end 106 of the moveable member 52 is configured such that the channel 82 guides or orients the moveable member. In particular, the first end 106 preferably has a width W4 corresponding to the width W2 of the channel 82, so that the moveable member 52 is aligned to cover the passage 90.

The first end 112 of the stop 54 is positioned adjacent to the first end 106 of the movable member 52. In the preferred embodiment, at least the first end 112 of the stop 54 is configured such that the channel 82 guides or orients the stop. In particular, the first end 112 preferably has a width W5 corresponding to the width W2 of the channel 82, so that the stop 54 is aligned with the moveable member 52.

Each of the first ends 106, 112 of the moveable member 52 and the stop 54 are secured to the valve body 42 by the fastener 56 that extends through the through holes 116, 118. In the illustrated embodiment, the fastener is a threaded member that threads into a corresponding threaded hole 120 formed in the valve body 42. Other types of fasteners, such as rivets for example, can be used to secure the valve construction to the valve body.

The moveable member 52 is configured such that the member 52 opens and closes to control fluid flow through the passage 90. In the illustrated embodiment, the moveable member 52 is a flexible construction that permits the second end 108 to flex or move relative to the first end 106. The flexible member 52 can include for example a reed construction, such as a reed pedal or flapper.

Figure 14:
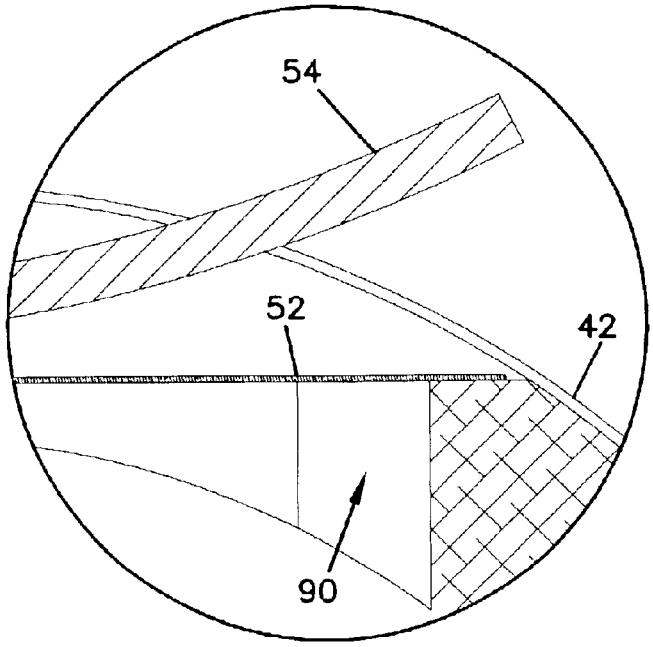
FIG. 14 is a detail view of FIG. 13, showing the valve assembly in a closed position.
Figure 15:
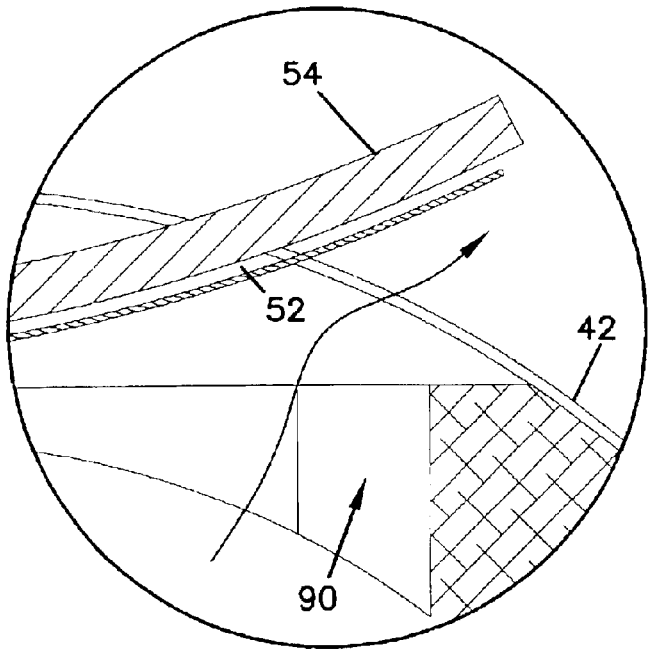
FIG. 15 is another detail view of FIG. 13, showing the valve assembly in an open position.

An enlarged detail view of the valve assembly 40 is shown in FIGS. 14 and 15. FIG. 14 shows the valve construction 50 of the valve assembly 40 in a closed orientation. In particular, the movable member 52 is positioned such that air is not permitted to flow through the passage 90. FIG. 15 shows the valve construction 50 in an open orientation. In particular, the movable member 52 is flexed away from the valve body 42 so that fluid communication is permitted to flow through the passage 90.

The stop 54 is configured to support the movable member 52 such that the movable member does not extend beyond a desired flexure. Referring back to FIG. 13, the second end 114 of the stop 54 extends at an angle A relative to the first end 112. The stop 54 is configured to be rigid or fixed in this angled orientation.

The orientation of second end 114 of the stop 54 relative to the first end 112 preferably corresponds to a desired opening movement or flexure of the movable member 52. That is, the desired opening movement or flexure of the moveable member 52 cannot be too great as to cause the moveable member to fail, but yet the desired opening movement or flexure must be great enough to permit sufficient airflow through the passage 90. In this embodiment, the angle A between the relative positions of the first and second ends 112, 114 of the stop 54 is preferably between 10 degrees and 45 degrees; more preferably, angle A is approximately 20 degrees.

In use, the present invention is designed to fit within an existing aperture of an engine wall through which a pinion shaft extends. The valve assembly is configured to seal around the pinion shaft and the inner diameter of the wall aperture. In addition, the present invention is designed to eliminate bi-directional airflow between the crankcase and cam chest and controls the airflow to, and pressure waves within, the cam chest and rocker box. This is achieved without additional machining costs associated with forming additional structure in the motorcycle engine wall. By eliminating bi-directional airflow, and controlling the pressure waves within, and airflow to, the cam chest, the present invention eliminates oil flow disruptions causing oil to exit from the breather vent, and improves upon fuel economy, engine horsepower, and overall engine performance.

The above specification provides a complete description of the present Valve Assembly invention. Since many embodiments of the invention can be made without departing from the spirit and scope of the invention, the invention resides in the claims hereinafter appended.

What is claimed is:

1. A reed valve assembly, comprising:

a valve body sized and configured to fit within a bearing aperture formed in a wall of a motorcycle engine, the valve body including a plurality of fluid communication passages; and a plurality of reed valve constructions secured to the valve body and positioned substantially adjacent to the plurality of fluid communication passages, the plurality of reed valve constructions being configured to provide one-way fluid communication through the plurality of fluid communication passages.

2. The reed valve assembly of claim 1, wherein:

the plurality of reed valve constructions include four reed valve constructions positioned adjacent to four fluid communication passages.

3. The reed valve assembly of claim 1, wherein:

the plurality of reed valve constructions each include a flexible member and a stop to limit movement of the flexible member when fluid communication is provided through the plurality of fluid communication passages.

4. The reed valve assembly of claim 1, wherein:

the valve body includes a central bore configured to encompass a shaft of the motorcycle engine.

5. The reed valve assembly of claim 4, further including:

a first seal positioned adjacent to the central bore and arranged to contact the shaft of the motorcycle engine to prevent fluid flow between the shaft and the central bore of the reed valve assembly.

6. The reed valve assembly of claim 1, further including:

a second seal positioned within a groove of the valve body and arranged to contact the bearing aperture formed in the wall to prevent fluid flow between the valve body and the bearing aperture.

7. A reed valve assembly, comprising:

a valve body sized and configured for receipt within an aperture formed in a wall of a motorcycle engine, the valve body including a plurality of fluid communication passages; and a plurality of reed valve constructions secured to the valve body and positioned substantially adjacent to the plurality of fluid communication passages, the plurality of reed valve constructions being configured to provide one-way fluid communication through the plurality of fluid communication passages, wherein the valve body is an annular ring body having an inner diameter, an outer diameter, and first and second sides.

8. The reed valve assembly of claim 7, wherein:

the fluid communication passages extend through the inner and outer diameters to provide fluid communication from the first side to the second side of the valve body.

9. A reed valve assembly, comprising:

a valve body sized and configured for receipt within an aperture formed in a wall of a motorcycle engine, the valve body including a plurality of fluid communication passages; and a plurality of reed valve constructions secured to the valve body and positioned substantially adjacent to the plurality of fluid communication passages, the plurality of reed valve constructions being configured to provide one-way fluid communication through plurality of fluid communication passages, wherein the valve body includes recesses within which each of the reed valve constructions are located.

10. A valve assembly, comprising:

a valve body having a central bore and at least a first fluid communication passage;

a first seal positioned adjacent the central bore of the valve body, the first seal being configured to engage a shaft positioned through the central bore; and a valve construction secured to the valve body and positioned adjacent to the first fluid communication passage, the valve construction including a moveable member configured to open and close fluid communications through the first fluid communication passage, wherein the valve body is configured to fit within a bearing aperture formed in a wall of a motorcycle engine.

11. The valve assembly of claim 10, wherein:

the moveable member includes a flexible reed member configured to open and close fluid communications through the first fluid communication passage.

12. The reed valve assembly of claim 11, wherein:

the valve construction includes a stop to limit movement of the flexible reed member when fluid communication is provided through the first fluid communication passage.

13. The valve assembly of claim 10, further comprising:

a plurality of valve constructions positioned adjacent to a plurality of fluid communication passages defined by the valve body.

14. The valve assembly of claim 10, further including:

a second seal positioned within a groove of the valve body and arranged to contact the bearing aperture formed in the wall to prevent fluid flow between the valve body and the bearing aperture.

15. A motorcycle engine, comprising:

a crankcase;

a cam chest mounted to the crankcase;

a shaft;

a wall between the crankcase and the cam chest, the wall defining an aperture through which the shaft extends; and a valve assembly positioned within the aperture, the valve assembly being configured to open and close in response to pressure differences between the crankcase and the cam chest, wherein the valve assembly includes a valve body having a central bore, the shaft of the motorcycle engine extending through the central bore when the valve assembly is positioned within the aperture of the wall.

16. The motorcycle engine of claim 15, wherein:

the valve body defines at least a first fluid passage and at least a first reed valve construction positioned adjacent to the first fluid passage, the first reed valve construction being configured to provide one-way fluid communication through the first fluid passage.

17. The motorcycle engine of claim 16, wherein:

the valve assembly further includes a plurality of fluid passages defined by the valve body, and a plurality of reed valve constructions positioned adjacent to the passages.

18. A valve assembly for use in an engine, comprising:

means for regulating a pressure difference between a first region of the engine and a second region of the engine;

means for supporting the means for regulating in an aperture of a wall between the first region and the second region; and means for supporting a shaft of the engine, the shaft extending through a central bore of the means for regulating.

19. The valve assembly of claim 18, further comprising:

means for recessing within the valve assembly a portion of the means for regulating.

* * * * *